United States Patent [19]

Yamatani

[11] Patent Number: 4,512,151

[45] Date of Patent: Apr. 23, 1985

[54] INTENSIFIER

[76] Inventor: Yoshiichi Yamatani, 1870 Manazuru, Manazuru-machi, Ashigarashimogun, Kanagawa-ken, Japan

[21] Appl. No.: 452,510

[22] Filed: Dec. 23, 1982

Related U.S. Application Data

[63] Continuation of Ser. No. 253,075, Apr. 10, 1981, abandoned, which is a continuation of Ser. No. 53,315, Jun. 29, 1979, abandoned.

[30] Foreign Application Priority Data

Jul. 13, 1978 [JP] Japan ..... 53-085426

[51] Int. Cl.[3] ..... F15B 7/00

[52] U.S. Cl. ..... 60/581; 60/593; 92/159; 92/174

[58] Field of Search ..... 60/534, 535, 562, 593, 60/581; 92/174, 84, 159

[56] References Cited

U.S. PATENT DOCUMENTS

| | | | |
|---|---|---|---|
| 1,579,409 | 4/1926 | Smith | 92/159 |
| 2,148,727 | 2/1939 | Carroll | 60/534 |
| 2,336,240 | 12/1943 | Gavin | 92/174 |
| 2,349,253 | 5/1944 | Edmund | 92/174 |
| 2,848,876 | 8/1958 | Schnell | 60/534 |
| 3,214,913 | 11/1965 | Hayman | 60/591 |
| 3,610,109 | 10/1971 | Verbeek | 92/84 |
| 3,698,190 | 10/1972 | Miyai | 60/562 |
| 3,981,148 | 9/1976 | McLuckie | 60/562 |
| 4,017,214 | 4/1977 | Smith | 92/80 |
| 4,028,891 | 6/1977 | Belart | 60/562 |
| 4,078,385 | 3/1978 | Zabadneh | 60/593 |
| 4,112,682 | 9/1978 | Harries | 60/581 |
| 4,171,665 | 10/1979 | Stoll | 92/159 |

FOREIGN PATENT DOCUMENTS

| | | | |
|---|---|---|---|
| 1083767 | 6/1960 | Fed. Rep. of Germany | 60/571 |
| 2382953 | 10/1978 | France | 92/159 |

*Primary Examiner*—Abraham Hershkovitz
*Attorney, Agent, or Firm*—Steele, Gould & Fried

[57] ABSTRACT

The invention relates to an intensifier using liquid, comprising at least one cylinder which has plural pistons and a lubricating chamber between them.

2 Claims, 2 Drawing Figures

INTENSIFIER

This is a continuation of application Ser. No. 253,075, filed Apr. 10, 1981, now abandoned, which is a continuation of application Ser. No. 53,315, filed June 29, 1979, now abandoned.

BACKGROUND OF THE INVENTION

In a conventional intensifier which uses water or slurry in the intensifying cylinder being connected to a driving cylinder acting piston or ram by oil, air, steam or crank mechanism, the sliding portion of the cylinder is worn out by the characteristic of the liquid being forced out when the pressure is high.

Therefore the liquid leaks out and the performance of the intensifier is very unstable and some troubles are often caused in operation.

SUMMARY OF THE INVENTION

In the present invention, it is characterized that plural pistons or rams are arranged in the intensifying cylinder and a lubricating chamber is provided between those pistons.

An object of the invention is to provide an intensifier to prevent wear of the sliding portion of the intensifying cylinder.

Another object of the invention is to increase the stability and reliability of the intensifier.

A further object of the invention is to provide an intensifier to operate efficiently smoothly a long time.

BRIEF DESCRIPTION OF THE DRAWING

For a fuller understanding of the invention, reference is had to the following description taken in connection with the accompanying drawings, in which.

DESCRIPTION OF THE PREFERRED EMBODIMENTS

The invention relates to an intensifier comprising plural pistons or rams in the intensifying cylinder and a lubricating chamber between them.

Figure 1:
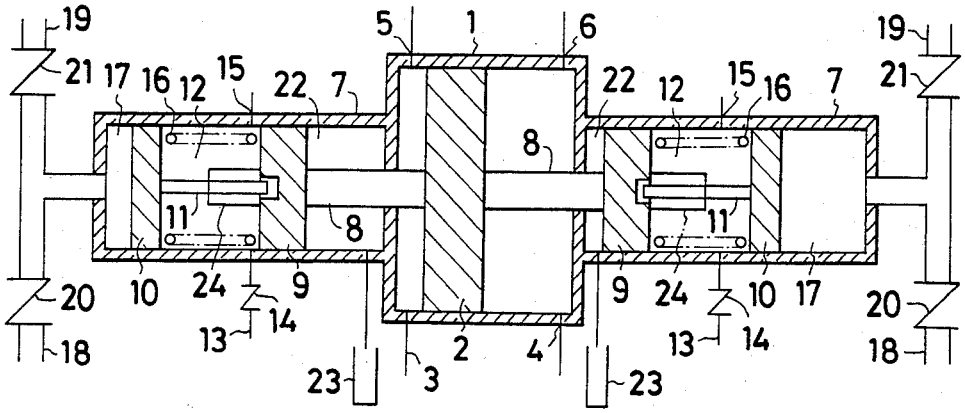
FIG. 1 is a schematic cross-sectional view of an apparatus embodiment in accordance with the invention and FIG. 2 is a partial detail of FIG. 1.

Referring now to FIG. 1, a driving cylinder 1 including piston 2 has inlets 3,4 and outlets 5,6 of liquid, and is connected to the intensifying cylinder 7. In the intensifying cylinder 7 the first piston 9 is provided and connected to the piston 2 in the driving cylinder 1 by connecting rod 8, and the penetrating parts of the connecting rod 8 extending through the driving cylinder 1 and the intensifying cylinder 7 are sealed with packing which is not shown in the drawings.

In the intensifying cylinder 7, the second piston 10 is connected to the first piston 9 by guiding rod 11 and a lubricating chamber 12 is provided between these pistons. In the lubricating chamber 12 between upper and lower dead points of the piston, an inlet 13 for lubricant with a check valve 14 and an opening 15 of inspection are provided. A spring 16 may be provided to the second piston 10. An inlet 18 and outlet 19 for water or slurry with check valves 20, 21 respectively are provided on the intensifying side 17 of the cylinder 7, and a leakage measuring tank 23 may be connected to the low pressure side 22.

In the drawings 24 is a stopper.

In the operation of the above embodiment, lubricant is forced into the lubricating chamber 12 through inlet 13, and oil under pressure is introduced from inlet 4 and discharged from outlet 5. Then the piston 2 slides to the left in FIG. 1. At the same time, the first and second pistons 9, 10 move simultaneously toward the left and the liquid in the intensifying side 17 is intensified and forced out through outlet 19. In such operation, the pressure of lubricant in the lubricating chamber 12 is always adjusted by spring 16 to equal to the pressure in the intensifying side 17, and then the leakage of the intensified liquid into the lubricating chamber 12 shall be prevented. The lubricant leaked into the low pressure side 22 through the piston 9 is measured by the measuring tank 23 and lubricant is supplied into the lubricating chamber 12. Next, introduction and discharge of oil under pressure into the cylinder 1 is changed, and the above described operation is done in the right side.

In such a manner, liquid is intensified and forced out by reciprocal operation of the left and right intensifying cylinders 7. Then the sliding portion of the intensifying cylinder 7 is always protected by lubricant in the lubricating chamber 12 which moves with the pistons, and wear is prevented. When the liquid in the intensifying side is sucked by motion of pistons, the pressure in the lubricating chamber 12 is always kept constant by spring 16 and cavitation in the lubricant can be prevented.

Figure 2:
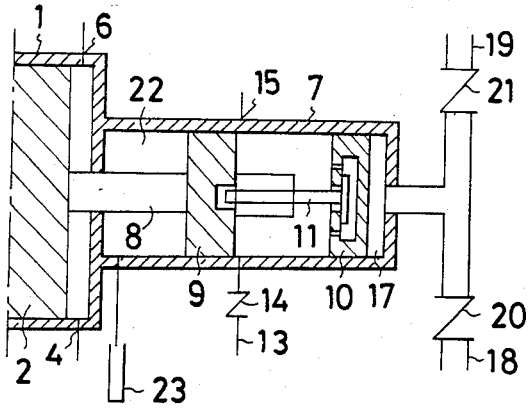

In FIG. 2, the second piston 10 and guiding rod 11 are connected loosely, and a gap 26 to the lubricating chamber 12 is provided by path 25. The gap 26 acts as a shock absorber between the second piston 10 and guiding rod 11 if the volume of the gap 26 shall be in anticipation of the compression ration of the lubricant and air mixed therewith.

According to the present invention as described above, the sliding portion of the intensifying cylinder is always protected from abrasion by lubricant in the lubricating chamber moving with the piston or ram, the intensifier can operate efficienty and smoothly for a long time and raises the stability and reliability.

What is claimed is:

1. In an intensifier to intensify fluid pressure of the type including a driving cylinder, a driving piston reciprocal within the driving cylinder to reciprocate a connecting rod, an intensifying cylinder adjacent to the driving cylinder and receiving one end of the connecting rod therein, a first piston connected directly to the connecting rod and being adapted for movement within the intensifying cylinder, the improvement comprising a second piston adapted for movement within the intensifying cylinder simultaneously with the first piston, the second piston being indirectly connected to the connecting rod;

a movable lubricating chamber defined in the intensifying cylinder intermediate the first and second pistons, the lubricating chamber being moved when the first and second pistons are moved;

the second piston being connected to the first piston by a guiding rod, the guiding rod having a first end connected to the first piston and a second end loosely connected to the second piston, the guiding rod always being positioned within the lubricating chamber, the second piston having limited axial movement within the intensifying cylinder relative to the first piston; and shock absorber means intermediate the connection between the second piston and the guiding rod second end, the shock absorber means comprising a gap in the second piston, the second end of the guiding rod being loosely retained in the gap and a path between the gap and the lubricating chamber, the path being sufficiently small to restrict the flow of lubricant from the lubricating chamber into the gap to modify the movement of the second piston relative to the first piston in accordance with the compression ratio of the lubricant; whereby variations in pressure in the intensifying cylinder may be compensated by the shock absorber means.

2. The intensifier of claim 1 and resilient means positioned in the lubricating chamber intermediate the first and second pistons to equalize the pressure within the lubricating chamber and the fluid pressure, the resilient means comprising a spring biasing between the first piston and the second piston.

* * * * *